United States Patent [19]

Gibot et al.

[11] Patent Number: 4,707,951

[45] Date of Patent: Nov. 24, 1987

[54] INSTALLATION FOR THE PROJECTION OF PARTICLES OF DRY ICE

[75] Inventors: Claude Gibot, Malakoff; Jean-Michel Charles, Marolles-en-Hurepoix, both of France

[73] Assignee: Carboxyque Francaise, Paris, France

[21] Appl. No.: 918,822

[22] PCT Filed: Feb. 4, 1986

[86] PCT No.: PCT/FR86/00029

§ 371 Date: Sep. 25, 1986

§ 102(e) Date: Sep. 25, 1986

[87] PCT Pub. No.: WO86/04536

PCT Pub. Date: Aug. 14, 1986

[30] Foreign Application Priority Data

Feb. 4, 1985 [FR] France ..... 85 01487

[51] Int. Cl.[4] ..... B24C 3/04

[52] U.S. Cl. ..... 51/410; 51/436; 51/320

[58] Field of Search ..... 51/319, 320, 321, 410, 51/436–437, 426, 427; 241/186 R, 186 A, 152 RA

[56] References Cited

U.S. PATENT DOCUMENTS

| | | | |
|---|---|---|---|
| 2,079,854 | 5/1937 | Hartshorne | 241/152 A |
| 2,815,716 | 12/1957 | Ransohoff . | |
| 3,089,775 | 5/1963 | Lindall | 51/320 |
| 3,139,705 | 7/1964 | Histed | 51/427 |
| 3,323,257 | 6/1967 | Fonti . | |
| 3,702,519 | 11/1972 | Rice et al. . | |
| 4,038,786 | 8/1977 | Fong | 51/322 |
| 4,389,820 | 6/1983 | Fong et al. . | |
| 4,428,535 | 1/1984 | Venetucci | 241/186 A |

FOREIGN PATENT DOCUMENTS

| | | | |
|---|---|---|---|
| 0140856 | 5/1985 | European Pat. Off. . | |
| 0168849 | 3/1906 | Fed. Rep. of Germany | 51/436 |
| 2285961 | 4/1976 | France . | |
| 2511628 | 2/1983 | France . | |
| 950078 | 2/1964 | United Kingdom . | |
| 1397102 | 6/1975 | United Kingdom . | |
| 1474374 | 5/1977 | United Kingdom . | |

*Primary Examiner*—Frederick R. Schmidt
*Assistant Examiner*—Robert A. Bose
*Attorney, Agent, or Firm*—Young & Thompson

[57] ABSTRACT

The installation comprises three units separated from one another: a grinding mill (1) fed with pieces of dry ice, a metering device (3) having an extracting spring-screw (13), and a propelling device (5) mounted in a vehicle gas conduit (4). The assembly is maintained under an atmosphere of $CO_2$ by a cover (6). Application in the cleaning of surfaces in the nuclear industry.

9 Claims, 2 Drawing Figures

INSTALLATION FOR THE PROJECTION OF PARTICLES OF DRY ICE

The present invention relates to an installation for dry ice blasting, i.e. an installation of the type comprising an apparatus for producing particles of dry ice or carbon dioxide ice, and a metering device for delivering a metered flow of these particles to a propelling device with which a vehicle gas conduit is provided.

As is known, the expansion of liquid carbon dioxide ($CO_2$) produces carbon dioxide snow which may be compacted so as to form pieces of carbon dioxide ice which are sublimated with heating. The installations of the aforementioned type deliver a metered flow of small particles of carbon dioxide ice or dry ice (having a dimension on the order of about 1 to 4 mm) in the vehicle gas conduit, which permits the projection of the particles onto a surface to be cleaned.

Thus dry ice blasting is similar to sand and shot blasting processes, but the sand or the shot is replaced by particles or grains of dry ice which, after having performed their abrasive function, are sublimated.

This technique has its field of application wherever treatment effluents of the liquid or solid type would be contaminated or not recoverable on the treating site. In nuclear applications for example, treatment by means of jets of water creates problems, since the water has a residue of radioactivity and the sand becomes contaminated and must be buried; on the other hand, gaseous $CO_2$, like most gases, may be easily decontaminated by filtration.

However, known dry ice blasting installations have not been fully satisfactory, in particular owing to the tendency of the particles of dry ice to set into a mass due to static electricity, which renders irregular the flow of the particles projected onto the surface to be treated.

An object of the invention is to provide an installation whereby it is possible to obtain a regular flow of particles in the vehicle gas conduit.

The invention therefore provides an installation of the aforementioned type, wherein said apparatus allows the particles to drop by gravity into the metering device, which is spaced from said apparatus, and the outlet of said apparatus and the parts of the installation where the particles are exposed to the surrounding atmosphere are surrounded by a cover for protecting said particles from humidity.

According to other advantageous features of the invention:

the metering device in turn allows said particles to drop by gravity into the propelling device which is spaced from the metering device, the cover surrounding the outlet of said apparatus, the metering device and the propelling device; said apparatus comprises a grinding mill and means for feeding pieces of dry ice to this mill.

Figure 1:
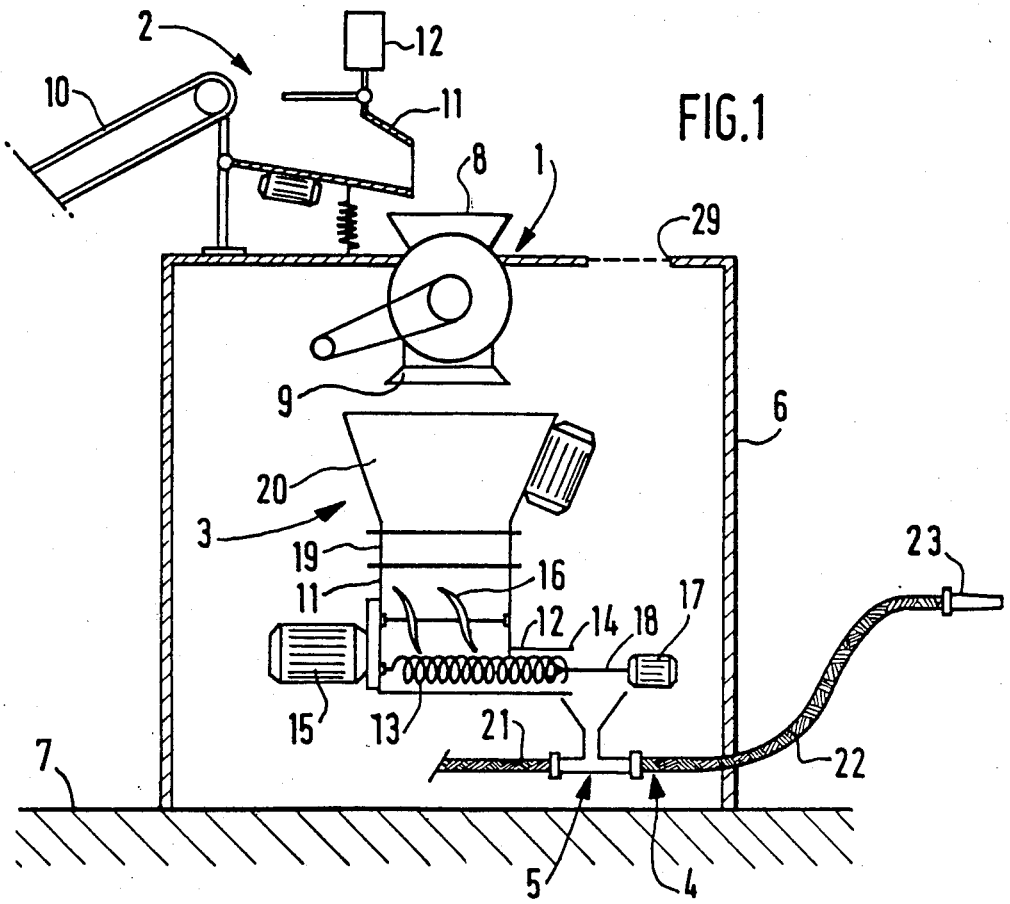
Figure 2:
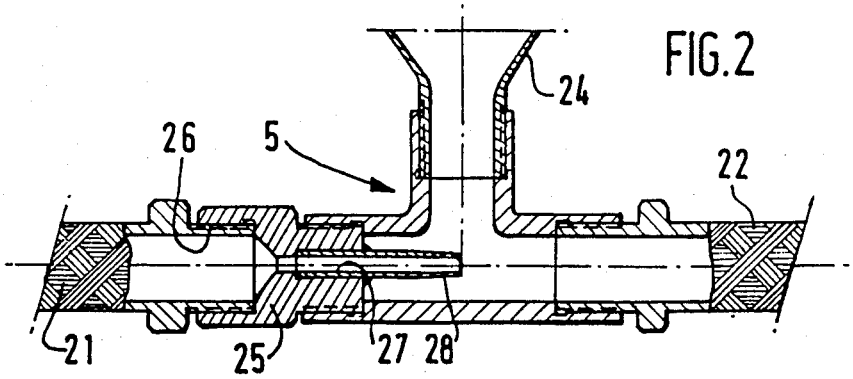

One embodiment of the invention will now be described with reference to the accompanying drawing, in which:

FIG. 1 is a diagrammatic elevational view, with a part in section, of a dry ice blasting installation according to the invention, and FIG. 2 is a longitudinal sectional view, to an enlarged scale, of the propelling device of this installation.

The dry ice or carbon dioxide ice blasting installation shown in the drawing mainly comprises a grinding mill 1, means 2 for feeding the mill, a metering device 3, a vehicle gas conduit 4 provided with a propelling device 5, and a metal cover 6 for protection against humidity. The elements 1 to 5 of the installation are mounted on a metal frame (not shown) fixed to the ground 7, the latter also supporting the cover 6.

The grinding mill 1 is a rod grinding mill. It includes an upper supply hopper 8 which is open at its upper end and a lower outlet conduit 9 open at its lower end.

The feed means 2 comprise a conveyor belt 10, a vibrating spout 11 which may be raised by means of a jack 12 and whose outlet is located above the hopper 8. The metering device 3 comprises a particle tank 11 provided at its lower end with a roughly horizontal outlet tube 12. A spring-screw 13 coaxial with the latter extends through the lower part of the tank 11 to the open outlet end 14 of the tube 12. A motor 15 drives in rotation the screw 13 and the stirring blades 16 also contained in the tank. Another motor 17 has an output shaft 18 whose end portion is fork-shaped and extends coaxially through the opening 14 into the interior of the end part of the screw 13.

The tank 11 is connected by a flexible section 19 to a vibrating hopper 20 which surmounts it. The inlet opening of the hopper 20 is coaxial with the outlet conduit of the grinding mill but is spaced therefrom, i.e. there is no contact between the grinding mill and the hopper 20.

The conduit 4 comprises an upstream pipe 21 connected to a source of vehicle gas, in particular gaseous $CO_2$ under pressure (not shown), and a downstream pipe 22 formed by a flexible hose which has no internal asperities and terminates in a rigid nozzle-tube 23. The pipes 21 and 22 of the conduit are interconnected by the propelling device 5 which is seen better in FIG. 2.

The device 5 comprises a tee coupling, the upwardly extending stem of which is extended by an inlet funnel 24. The lower outlet branch of the tee is directly connected to the hose 22 while its lower inlet branch is connected to the pipe 21 through an ejector. The latter is formed by an end member 25 having a large inlet bore 26 and a small outlet bore 27. The first bore is tapped and screwed on the end of the pipe 21, and there is fixed in the second bore the upstream end of an ejection nozzle 28 whose downstream end is located on the axis of the funnel 24. The inlet edge of this funnel is located below the outlet opening 14 of the tube 12 but spaced from the latter, i.e. with no contact therewith.

The cover 6 surrounds all the elements of the installation except for the upper hopper 8 and the hose 22 which extend therethrough with an approximate seal, and the feed device 2 which is completely outside the cover.

In operation, the machine (not shown) for producing pieces of dry ice pours these pieces onto the upstream end (not shown in the drawing) of the belt 10. These pieces are for example small rods having a diameter on the order of 15 mm and a length on the order of 25 mm. Such rods may be produced in a very reliable manner but are too large to be used directly in dry ice blasting.

The belt 10 pours by gravity the pieces of dry ice into the spout 11, which is assumed to be in the lowered active position and from which the pieces drop by gravity into the hopper 8 of the grinding mill 1. In the latter, the pieces are converted into very jagged small particles whose dimension varies, for example, for a given application, from about 0.5 mm to about 1.5 mm. These particles drop by gravity into the vibrating hopper 20 and are stirred by the blades 16. The spring-screw 13 is driven in rotation in such manner as to extract a given flow of particles through the opening 14 of the tube 12.

The rotation in the opposite direction of the shaft 18 avoids the formation of lumps of particles corresponding to the pitch of the spring at the opening 14. Thus, a regular flow of particles drops into the funnel 24.

The vehicle gas ejected at high velocity through the nozzle 28 creates in the funnel 24 a depression which entrains the particles in the stream of gas by the venturi effect.

This installation has given full satisfaction. Surprisingly, it has been found that there is no setting of the particles into a mass in the hopper 20 and the tank 11. The rate of flow of projected particles is constant and it has been possible to clean under very good conditions metal sheets covered with paints having a very high adherence: the metal took on a polished appearance with no deterioration of its surface. Moreover, the loss of $CO_2$, ascertained mainly in the region of the grinding mill, is on the order of 5%, which is quite acceptable. Further, during the putting of the installation into a cold state, the sublimation of the dry ice gives off dry gaseous $CO_2$ which, as it is heavier than air, gradually fills the cover 6 and expels the air and humidity until it overflows through an upper opening 29 in the cover and, to a lesser extent, through the clearances between the latter and in particular the hose 22 and the grinding mill 1. Thus, all the parts of the installation in which the particles of carbon dioxide ice are exposed to the surrounding atmosphere (hopper 20, opening 14, funnel 24) are maintained under an atmosphere of dry $CO_2$ under a pressure in the neighbourhood of atmospheric pressure, which precludes any penetration of humidity within the particles.

Moreover, the division of the installation into three sub-assemblies 1, 2 and 4 with no mutual contact therebetween, ensures that excessive stresses of thermal origin do not develop and permits an easy intervention in the event of failure of an element.

In practice, the rate of ejection of the particles through the tube 23 is governed by the speed of rotation of the spring-screw 13. The rod plates of the grinding mill and their speed of rotation are so chosen as to obtain a mean particle size which may vary for example between 1 and 4 mm and a rate of flow of grand particles slightly higher than the ejection rate of flow. The feed of the grinding mill is intermittent and controlled by the raising or lowering of the spout 11 by means of the jack 12, in accordance with the level of the particles in the hopper 20.

As an alternative, in respect of non-permanent installations, the unit comprising the machine producing the rods and the feed device 2 may be replaced by a simple tank storing dry ice rods with any suitable means for charging these rods into the hopper 8.

We claim:

1. A dry ice blasting installation comprising an apparatus for producing particles of dry ice, said apparatus having an outlet, a vehicle gas conduit having an outlet nozzle, a propelling device disposed in said conduit, and a matering device for delivering a metered flow of said particles into said propelling device, said metering device having an inlet disposed below and spaced from said outlet whereby said particles are allowed to drop by gravity from said apparatus into the metering device, and a cover which surrounds said outlet of said apparatus and every part of the installation where particles are exposed to the surrounding atmosphere except for said outlet nozzle, so as to protect said particles from humidity until they are blasted out of said nozzle.

2. A dry ice blasting installation comprising an apparatus for producing particles of dry ice, said apparatus having an outlet, a vehicle gas conduit having an outlet nozzle, a propelling device disposed in said conduit, and a metering device for delivering a metered flow of said particles into said propelling device, said metering device having an inlet disposed below and spaced from said outlet whereby said particles are allowed to drop by gravity from said apparatus into the metering device, said propelling device having an entrance disposed below and spaced from a discharge orifice of said metering device whereby said particles are allowed to drop by gravity from said metering device into said propelling device, and a cover surrounding said outlet and said metering device and said propelling device so as to protect said particle from humidity until they are blasted out of said nozzle.

3. An installation according to claim 1, wherein said apparatus comprises a grinding mill and means for feeding pieces of dry ice to said grinding mill.

4. An installation according to claim 2, wherein said apparatus comprises a grinding mill and means for feeding pieces of dry ice to said grinding mill.

5. An installation according to claim 1, wherein said metering device comprises a hopper located under said outlet of said apparatus, a tank located under said hopper, a hollow extracting screw disposed at a lower end of said tank and having an outlet end adjacent said discharge orifice, and a stirrer which extends into said outlet end of said screw.

6. An installation according to claim 4, wherein said hopper is a vibrating hopper and a stirring means is disposed in said tank.

7. An installation according to claim 1, wherein said conduit has a section in which is provided a vehicle gas ejecting nozzle and said propelling device comprises a funnel which opens into said section of said conduit, said ejection nozzle terminating under said funnel.

8. An installation according to claim 1, wherein the cover is under substantially atmospheric pressure.

9. An installation according to claim 2, wherein the cover is under substantially atmospheric pressure.

* * * * *